US006907628B2

(12) United States Patent
El Guermaai

(10) Patent No.: US 6,907,628 B2
(45) Date of Patent: Jun. 21, 2005

(54) BEDSHEET RETAINER SYSTEM

(76) Inventor: Mustapha El Guermaai, 8270, Courval, St-Leonard, Quebec (CA), H1X 1M4

( * ) Notice: Subject to any disclaimer, the term of this patent is extended or adjusted under 35 U.S.C. 154(b) by 0 days.

(21) Appl. No.: 10/660,164

(22) Filed: Sep. 12, 2003

(65) Prior Publication Data

US 2005/0055771 A1 Mar. 17, 2005

(51) Int. Cl.[7] ..... A47G 9/04
(52) U.S. Cl. ..... 5/498; 5/494; 24/72.5
(58) Field of Search ..... 5/494, 496, 498; 24/72.5

(56) References Cited

U.S. PATENT DOCUMENTS

| | | | | | |
|---|---|---|---|---|---|
| 267,498 | A | | 11/1882 | Cox | |
| 728,204 | A | | 5/1903 | Coffman | |
| 807,658 | A | * | 12/1905 | Campbell | 5/498 |
| 1,468,624 | A | * | 9/1923 | Bennett | 24/72.5 |
| 1,491,160 | A | * | 4/1924 | Meunier | 24/72.5 |
| 2,103,244 | A | * | 12/1937 | Briscoe | 24/72.5 |
| 2,321,394 | A | | 6/1943 | King | |
| 2,459,497 | A | | 1/1949 | Calabro | |
| 2,507,091 | A | * | 5/1950 | Carlson | 24/72.5 |
| 2,988,759 | A | | 6/1961 | Gerdes | |
| 4,276,667 | A | | 7/1981 | Osbourne | |
| 4,541,137 | A | | 9/1985 | Murray | |
| 4,662,016 | A | | 5/1987 | Seeman | |
| 5,400,478 | A | | 3/1995 | Levinsohn et al. | |
| 5,467,491 | A | * | 11/1995 | Griffith | 5/658 |

* cited by examiner

*Primary Examiner*—Michael Trettel

(57) ABSTRACT

A bedsheet retainer system consisting of a plurality of clips grappling a single latte around which the bedsheets are wrapped.

3 Claims, 2 Drawing Sheets

BEDSHEET RETAINER SYSTEM

BACKGROUND OF THE INVENTION

This invention relates to fasteners in general but more specifically to devices for holding bedsheets and bedcovers in position in a bed.

To eliminate situations where bedsheets and bedcovers get displaced and bundled up helter skelter, devices and systems have been proposed in the past. The prior art demonstrates numerous systems in the form of strap holders with parts held underneath the mattress or else, looped around a bed rail or frame with the other end clipped or otherwise attached to the bedsheets. Some of the prior art shows multiple clips with each one holding an individual piece of bed covering. These prior art holders are generally narrow and come in two or more discrete units so that there are enough clips to hold bedsheets properly across the bed's width, especially for the needs of a queen or king size bed.

Because of the multiplicity of the components required, the rather awkward installation of those components as well as other issues such as the type of grappling means which can damage bedsheets—such as the use of tines or teeth—there is a need for an improved bedsheet retainer.

SUMMARY OF THE INVENTION

It is therefore a first object of this invention to provide for a simple and practical way of holding in place bedcovers.

It is a second object of this invention to provide for a modular system adaptable to any bed width.

In order to do so, the bedsheet retainer system consists of at least one clip but preferably a plurality of clips and a slat. Bedsheets are wrapped around the slat and all are grappled by the clips and the whole is tucked underneath the mattress.

The foregoing and other objects, features, and advantages of this invention will become more readily apparent from the following detailed description of a preferred embodiment with reference to the accompanying drawings, wherein the preferred embodiment of the invention is shown and described, by way of examples. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

For the sake of simplicity, the term bedsheet(s) will mean bedsheet and bed cover.

DETAILED DESCRIPTION OF THE PREFERRED EMBODIMENT

Figure 1:
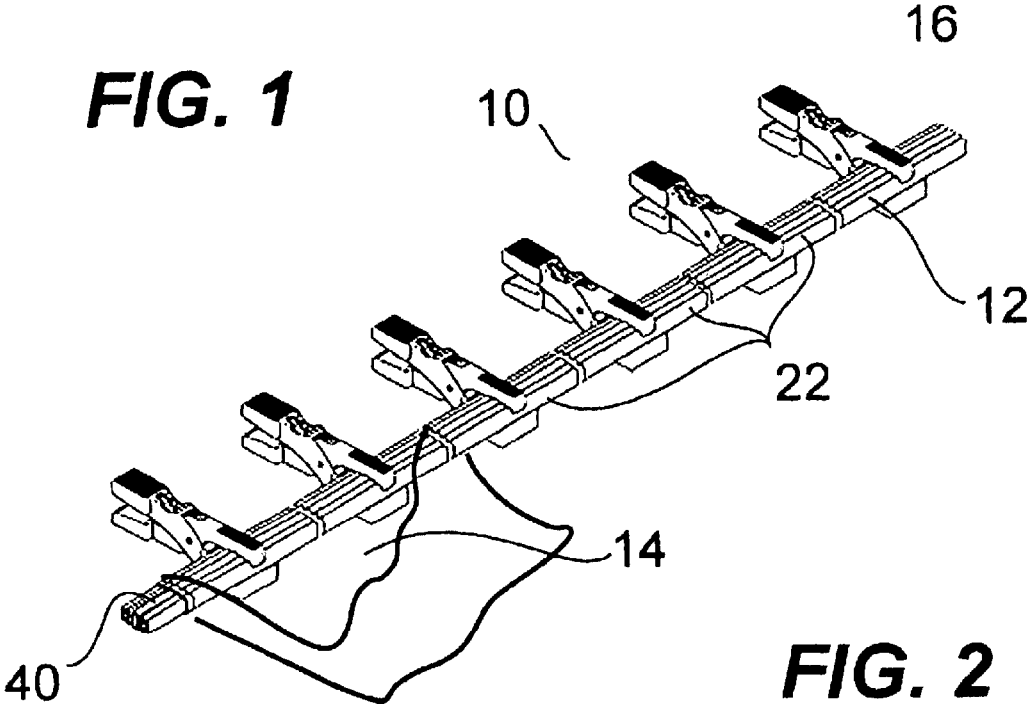
FIG. 1 perspective view of the bedsheet retainer system.
Figure 2:
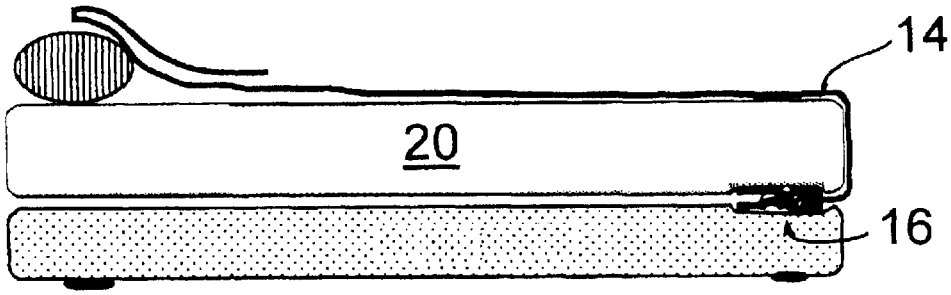
FIG. 2 side elevation of a bed retainer system in use.
Figure 3:
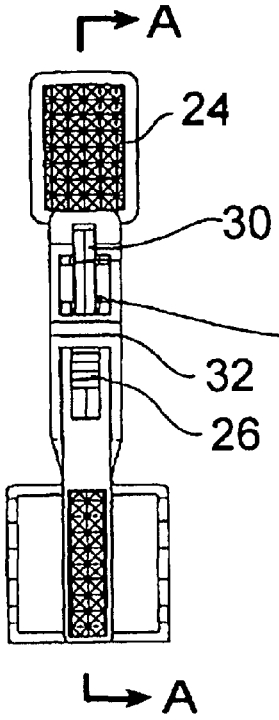
FIG. 3 top view of the clip.
Figure 4:
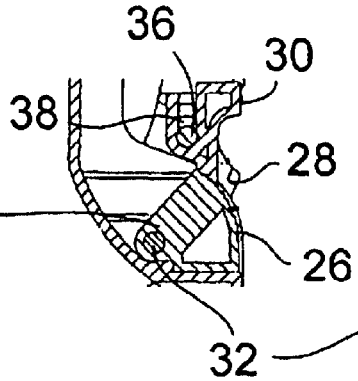
FIG. 4 cross sectional detail of clip ratchet along line A—A [of FIG. 3].
Figure 5:
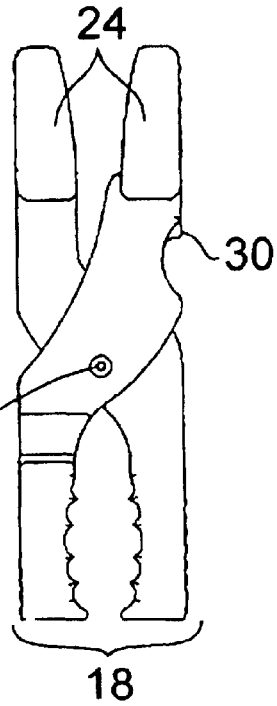
FIG. 5 side view of clip.
Figure 6:
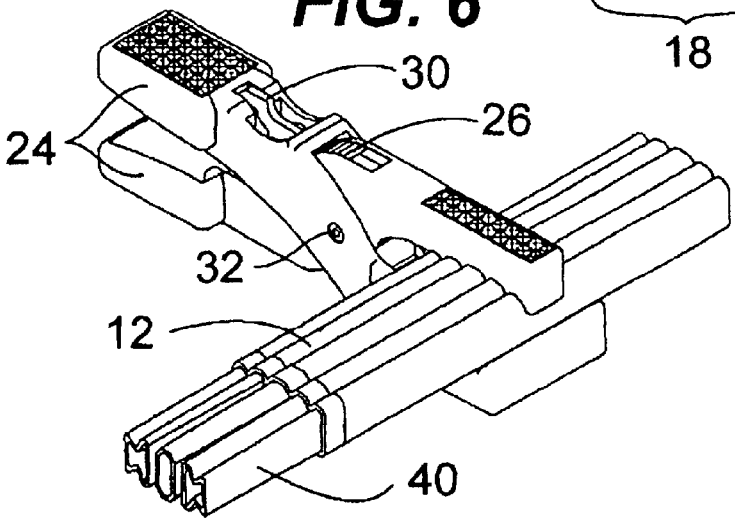
FIG. 6 perspective view of the bedsheet retainer system.

A bedsheet retainer system (10) has a slat (12) around which bedsheets (14) are wrapped, and one or more clips (16). The slat (12) is separate and distinct from the clip (16) and is held within the clip's (16) jaws (18) along with the bedsheets (14). Bedsheets (14), slat (12) and clips (16), all are tucked underneath a mattress (20). The slat (12) consists of a plurality of interconnected slat segments (22) connected in a male-female fashion by way of a protrusion received within a socket (40).

The clip (16) has a pair of handles (24) rotating around an axis (32), on the other side of the axis (32), opposite the handles (24) are the jaws (18) and proximal that axis (32) is a ratchet (26) which cooperates with a pawl (28) having a depressable button (30) integral to it to disengage the pawl (28) when removing the bedsheets (14).

When inserting the slat (12) and the bedsheets (14) into the jaws (18), the adjustable clip (16) can easily be closed tight on the bedsheets (14) by applying pressure on the handles (24) but because of the ratchet (26), the handles (24) cannot open without depressing the button (30). Once the button (30) is depressed and with the help of a biasing means (34) set around the axis (32), the handles (24) rotate and open the adjustable clip (16) to free the bedsheets (14). The button (30) itself has a button axis (36) and a button biasing means (38) so that the pawl (28) is biased toward the ratchet (26). The ratchet (26) allows the jaws (18) to retain a degree of closure to hold the bedsheets (14) while being releasable by depressing the button (30) so as to selectively free the bedsheets (14) and the slat (12) as well.

What is claimed is:

1. A bedsheet retainer system for retaining bedsheets comprising:

a slat around which bedsheets are wrapped;

at least one clip to clip to said slat;

said slat being separate and distinct from said clip;

said slat consisting of a plurality of interconnected slat segments connected in a male-female fashion by way of a protrusion received within a socket.

2. A bedsheet retainer system for retaining bedsheets as in claim 1 wherein:

said clip having a ratchet cooperating with a pawl and said pawl further comprising a depressable button to selectively disengage said pawl from said ratchet;

handles moving around an axis;

a biasing means set around said axis to bias said handles;

jaws situated opposite said handles and cooperating with said handles to hold said slat and said bedsheets.

3. A bedsheet retainer system for retaining bedsheets as in claim 2 wherein:

said button having a button axis and a button biasing means so that said pawl can return to said ratchet;

said ratchet allowing said jaws to retain a degree of closure while being releasable so as to free said bedsheets.

* * * * *